United States Patent [19]

Simons

[11] Patent Number: 4,757,788

[45] Date of Patent: Jul. 19, 1988

[54] IGNITION SYSTEM

[76] Inventor: Sylvan Simons, Video Manufacturing Corp., 45 Don Bosco Pl., Portchester, N.Y. 10573

[21] Appl. No.: 22,991

[22] Filed: Mar. 6, 1987

[51] Int. Cl.[4] ..... F02P 3/04; F02N 17/08

[52] U.S. Cl. ..... 123/154; 123/179 BG; 123/145 A

[58] Field of Search ..... 123/145 A, 154, 156, 123/162, 179 B, 179 BG, 179 H

[56] References Cited

U.S. PATENT DOCUMENTS

| | | | |
|---|---|---|---|
| 974,824 | 11/1910 | Rauch | 123/154 |
| 1,065,862 | 6/1913 | Bullock | 123/154 |
| 1,138,512 | 5/1915 | Stempel | 123/154 |
| 1,355,358 | 10/1920 | Rasmussen | 123/154 |
| 1,441,711 | 1/1923 | Petter | 123/145 A |
| 4,475,492 | 10/1984 | Furukawa et al. | 123/179 BG |
| 4,487,177 | 12/1984 | Ishikawa | 123/179 BG X |

*Primary Examiner*—Willis R. Wolfe

*Attorney, Agent, or Firm*—Alfred E. Miller

[57] ABSTRACT

An ignition system for an internal combustion engine has one electrode in the cylinder movable with respect to the other, under the control of an external solenoid, or other operable device. The solenoid or other device is actuated, and the current to the electrodes is derived from the collapsing field of an inductor. A diode inhibits other than discharge current of said inductor from flowing to said electrodes.

10 Claims, 1 Drawing Sheet

IGNITION SYSTEM

This invention relates to ignition systems, and is more particularly directed to an improved ignition system especially adapted for internal combustion engines either of the type wherein a spark is produced in a combustion chamber of an internal combustion engine upon the separation of a pair of contacts or as an improvement over the "glow plug" commonly used as a starting aid in diesel engines.

Ignition systems employing make and break contacts within the cylinder of a spark ignited internal combustion engine are discussed in "Automotive Ignition Systems", F.C. Derato, McGraw Hill Book Company, New York, 1982, referring to experiments in 1983 by the Duryea Brothers. In the Duryea arrangement, a movable contact was tripped by a cam inside of the cylinder, to interrupt current flowing through an inductor.

U.S. Pat. Nos. 795,459 and 795,460, Thurston, disclosed a system in 1905 wherein the movable contact was directly controlled by a solenoid.

U.S. Pat. No. 895,958, Carlborg, 1908, discloses a system of this type wherein the mechanical movement for actuating a rotary contact within the cylinder was controlled by electromagnets positioned externally of the cylinder.

Ignition systems of this type have the disadvantage that make and break contacts required inside of the combustion chamber are subject to excessive wear due to their exposure to the heat and corrosiveness of the products of combustion and the functional arcing. These disadvantages, and the development of systems for producing adequately high spark voltages, led to the disuse of movable gap devices in favor of fixed electrode devices such as spark plugs. The high voltage, or Kettering system, having "breaker points" outside of the hostile atmosphere of the combustion chamber with its heat of combustion and products of combustion, and the use of a capacitor across breaker points to reduce arcing since such arcing is no longer functional, is not subject to as great deterioration as make and break contacts within the combustion chamber.

The high voltage systems are subject to various disadvantages, however, since the intensity of the high voltage and therefore the intensity of the spark is limited by the insulation restraints of the spark plug, the connecting wires, the ignition oil, and the distributor. This disadvantage limits the acceptability of high voltage ignition systems, especially in view of the current accent on the provision of greater engine efficiencies and reduced emission of pollutants, since these desireable attributes can be better achieved by the provision of greater ignition power in the spark.

Various attempts have been made to overcome the shortcomings of high voltage ignition systems. Thus, there has currently been done some considerable development of engines having auxiliary combustion chambers acting as a torch to ignite lean mixtures in a main combustion chamber. Such engines with auxiliary combustion chambers require an extra set of valves, if the engines are not to suffer "breathing" problems in exhausting the products of combustion in the auxiliary chamber from the previous cycle.

The present invention is therefore directed to the provision of an improved ignition system for a spark ignited engine of the type having "break" contacts or electrodes within the combustion chamber, and "make" contacts outside the combustion chamber, the system thereby not having the above limitations of high voltage systems as discussed above, nor the economic disadvantages of auxiliary chamber systems as discussed above.

The present invention is also directed to a starting aid for a Diesel engine to replace and improve upon the performance of "glow plugs". The higher temperature of the spark making unnecessary the delay to worm up and use of auxiliary starting chambers and poor cold weather starting characteristics.

Briefly stated, in accordance with the invention, I provide an ignition system of the type employing break electrode contacts within the combustion chamber, including a movable electrode contact magnetically controlled by a solenoid. The invention further provides a control system wherein a charging coil or inductor is connected to be discharged through the solenoid and electrode contacts within the combustion chamber, the current being directed by way of a diode. The inductor is charged by way of a charging circuit including externally operated points or the like, the diode isolating the charging and discharging cycles of the inductor.

In order that the invention may be more clearly understood, it will now be disclosed in greater detail with reference to the accompanying drawings, wherein.

Figure 1:
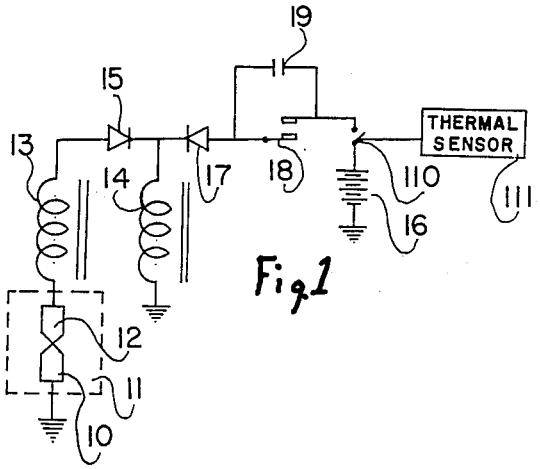
FIG. 1 is a simplified circuit diagram of the circuit of an ignition system in accordance with one embodiment of the invention.

Referring now to the drawings, and more in particular to FIG. 1, a movable contact or electrode 10 within a combustion chamber indicated by the dashed lines 11, initially contacts movable contact or electrode 12 connected in series with a solenoid 13. The solenoid is mechanically coupled to the contact or electrode, so that upon energization, it withdraws the movable contact or electrode 12 from contacting relationship with the fixed contact or electrode 10. The movement may be effected directly, for example, by employing the contact or electrode 12 as part of or an extension of the plunger of the solenoid, or the magnetic force of the solenoid 13 may be indirectly coupled to move the movable contact or electrode 12, for example with a rotary movement as will be discussed. The circuit further includes an inductor 14 having one end grounded and the other end coupled to the free end of the solenoid 13 by way of a diode 15. The inductor 14 is charged by way of a source 16 of current, such as a battery or the like, contacts or points 18 adapted to be controlled, for example, by way of a cam (not shown) synchronized with the rotation of the engine. A capacitor 19 may of course be connected in parallel with the points to reduce sparking, in the conventional manner.

In operation of the circuit of FIG. 1, upon closing of the points or contacts 18, a connection path is established between the battery 16 and the inductor 14 to effect the charging of the inductor. Current flow into the solenoid 13 is prevented at this time due to the diode 15 connected in series therewith. Upon opening of the points or contacts 18, current from the battery ceases, and the magnetic field in the inductor collapses, thereby generating a reverse polarity voltage across the inductor. This reversal effects the flow of current through the diode 15, and hence through the solenoid 13 and the touching contacts or electrodes 10 and 12 in the combustion chamber. The flow of current through the solenoid causes the separation of the contacts or electrodes 10 and 12 due to the energizing of the magnetic field of the solenoid, thereby causing an arc to be produced between the contacts or electrodes 10 and 12. When energy in the inductor 14 has dissipated, the magnetic field of the solenoid 13 collapses and the movable contact or electrode 12 returns to contacting relationship with the fixed contact or electrode 10.

Although the contacts or electrodes 10 and 12 normally touch, any contact resistance that may build up due to use will have negligible effect on the operation of the system since the voltage will build up to whatever is necessary to maintain the arc across the contacts or electrodes and dissipate the stored energy in inductor 14. Since the resistance at the contacts or electrodes 10 and 12 is much higher than the remainder of the circuit, then by applying the Ohm's Law formula of current multiplied by resistance, except for the negligible losses in the rest of the circuit, all the stored energy will appear at contacts or electrodes 10 and 12 as arcing. It is the feature that the contacts or electrodes 10 and 12 are used only for discharging current whereas the inductor is charged by a separate circuit that distinguishes the system of my invention from previous make and break ignition circuits.

In addition, since my system is a low voltage system, spark plug insulator fouling or other insulation breakdown is not a problem, whereas it is with the Kettering high voltage ignition systems, because in my system the voltage necessary to cause arcing appears only at igniter contacts or electrodes 10 and 12 and then only upon separation of contacts or electrodes 10 and 12 whereas insulator breakdown is a common complaint of the Kettering high voltage system.

Although it is possible for the gap between contacts or electrodes 10 and 12 to open wider than those generally employed in the fixed gap of a Kettering high voltage system, this is not essential for a hotter spark since the contacts or electrodes may be shaped for maximum spark intensity rather than for the jumping of a fixed gap as in the Kettering system.

In one example of the invention as illustrated in FIG. 1, the solenoid 13 had a 0.8 Ohm coil and was from a Standard Motor Product's 6 Volt voltage regulator. The diode was 1000 Volt 2.5 Amp diode. The inductor 14 was comprised of a Stancor C2690 choke having 75 millihenrys inductance and 0.75 Ohms resistance. The battery was a 12 Volt battery. The breaker points and capacitor in parallel therewith were automotive type DC-13.

Figure 2:
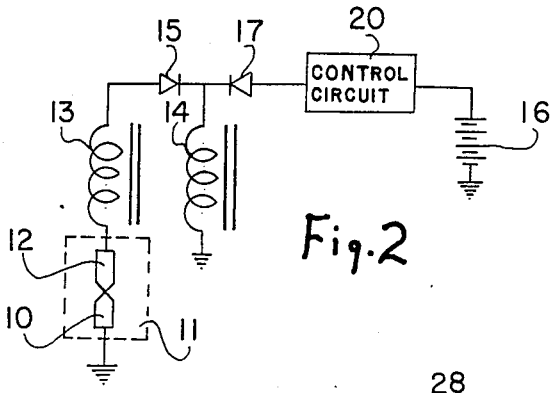
FIG. 2 is a simplified circuit diagram of a modification of the circuit of FIG. 1.

In the modification of the circuit of FIG. 1 as illustrated in FIG. 2, the points 18 and capacitor 19 have been replaced by a control circuit 20, which may be a conventional solid state switching circuit. This modification thereby provides the improved reliability of solid state systems.

The ignition system in accordance with my invention thereby employs "breaker points" or the equivalent thereof to initiate inductor energy storage when the contacts are closed, and to release the stored energy upon opening of the contacts to cause a reversed current flow through the inductor upon the collapse of the inductive field of the inductor. This reversed current is directed by a diode through the "sparking" plug. The system does not require the use of a transformer to step up the voltage in order to jump a spark plug gap.

Since the contacts or electrodes in the "sparking" plug in the combustion chamber normally touch, it requires only a small enough voltage to overcome the contact resistance plus the resistance of the solenoid coil and the voltage drop in the diode 15, to cause the current to flow. Once current flows through the "sparking" plug, the armature or plunger of the electric magnet solenoid moves the movable contact or electrode 12 to open the gap and maintain it open and arcing until the energy stored in the inductor has been dissipated.

The ignition system in accordance with the invention is not limited for use solely with gasoline engines. It may thus be employed advantageously for the starting of a diesel engine by injecting fuel in its vicinity, without the fouling problem of high voltage spark plugs. It may also be employed to fire internal combustion engines employing alternate fuels, as a result of the reduced fouling problem attendant with low voltage firing.

Figure 3:
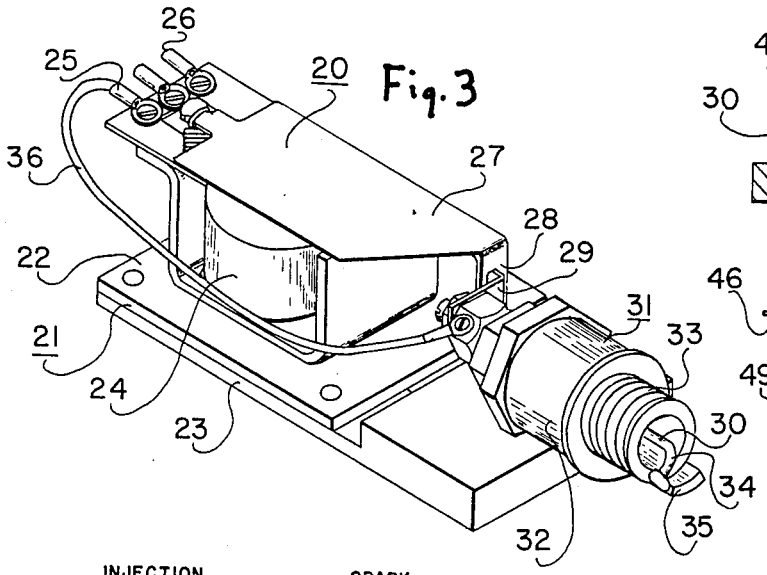
FIG. 3 is a perspective drawing of a spark plug assembly in accordance with one embodiment of the invention.

In the embodiment of the invention as illustrated in FIG. 3, disclosing a sparking plug assembly, a solenoid in the form of a relay 20 is mounted on a base 21. Specifically, the solenoid is affixed to an insulating plate 22 mounted to a metallic base plate 23. The solenoid includes a coil 24 connected between terminals 25 and 26. The movable arm 27 of the relay has an extension 28 pivotally coupled to rotate a crank arm 29 of the center arm 30 of a plug 31. The plug may have a metallic outer casing 32 welded or otherwise rigidly affixed to the plate 23, and having a threaded end 33 adapted to be threaded into the spark plug opening of an internal combustion engine. The end 34 of the rotatable center arm 30 extending through the sparking device is bent as illustrated at 34, to provide a movable contact or electrode associated with a fixed contact or electrode 35 depending from the end of the sparking device 31. The terminal 25 is securely connected with the contact rod 30 by way of the lead 36.

It is thus apparent that, upon energization of the solenoid coil 24, the arm 27 thereof rotates the crank 29, and hence the rod 30. Such rotation effects the separation of the contact or electrode end 34 of the rod with the fixed contact projection 35. The contact projection 35 is grounded to the engine by way of the shell 32 of the sparking device and the threads 33 thereof. The metallic base plate 23 serves to dissipate heat, the insulating plate 22 insulating the solenoid structure from the heat of the engine.

It is, of course, apparent that FIG. 3 illustrates only one possible embodiment of the invention, and that any conventional magnetic or other actuating arrangements may alternatively be employed, either for rotating a contact electrode or linearly moving a contact electrode.

Figure 4:
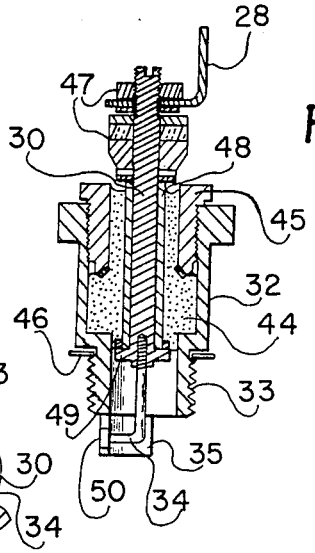
FIG. 4 is a cross sectional view of a "spark plug" employed in the assembly of FIG. 3.

The sparking plug of FIG. 3 is illustrated in cross section in FIG. 4, and is comprised of the hollow shell 32 having a threaded end 33, with a solid (for example ceramic) insulator 44 being held within the shell 32 by a retaining plug 45. A conventional sealing washer 46 is provided adjacent the threaded end of the device. The crank arm 29 is held to the threaded end of the contact or electrode rod 30 by any conventional means, such as locking nuts 47, so that rotation of the crank arm 29 effects rotation of the rod. The rod 33 may extend through a sealing bushing 48 in the insulator 44, and may be provided with a lower flange 49 retaining the rod 30 in the insulator, along with the locking nut assembly. A contact or electrode 50 is provided on the bent end 34 of the contact or electrode rod, to circumferentially abut the axially extending contact projection 35.

It is, of course, apparent that this embodiment of the sparking plug is illustrative only, and other arrangements may obviously be employed within the scope of the invention.

Figure 5:
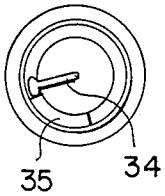
FIGS. 5–6 are end views of the sparking device employed in the system by FIG. 3 at different positions of the movable electrode contact.
Figure 6:
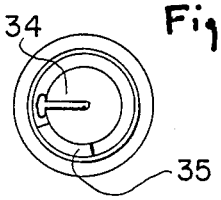

FIG. 5 illustrates an end view of the plug of FIG. 4, with the contact or electrode 50 contacting the contact or electrode projection 35, in the normal unerergized state of the solenoid 24. FIG. 6 illustrates the contact or electrode 50 separated from the fixed contact or electrode projection 35, in the energized state of the solenoid 24. It is of course apparent that the extent of opening of the gap may be varied, independent upon the mechanical linkage and crank arm 29.

Figure 7:
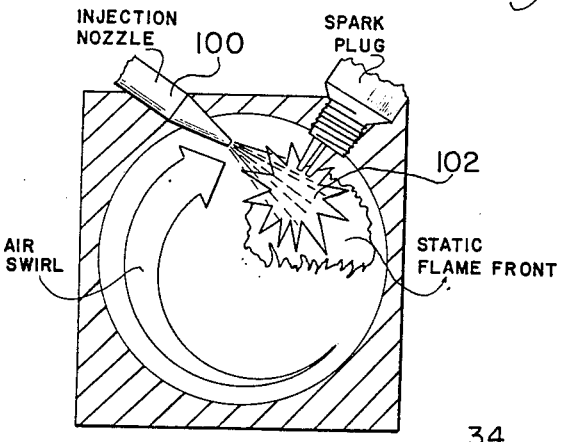
FIG. 7 illustrates the sparking device of the invention in combination with an injection nozzle.

FIG. 7 shows an engine where the fuel is sprayed onto or close to the sparking contacts by injection nozzle 100 either for a spark ignited internal combustion engine or as a starting aid for a diesel engine, the sparking contacts 102 replacing and improving upon conventional "glow plugs". This engine would be impractical with the Kettering high voltage ignition system because of fouling of spark plug caused by fuel spray.

A feature of the engine of FIG. 7 is that although the sparking contacts are exposed to a rich mixture providing for rapid reliable combustion, the air to fuel mixture for the cylinder as a whole can be high because the rich mixture flame will be a torch to ignite the lean mixture with the attendant benefits such as better fuel economy and lower pollution that accompanies a lean mixture.

When the ignition system of the invention is employed only as a starting aid, it may be disabled, for example by a switch 110 (FIG. 1), under control of a thermal sensor 111 responsive to engine temperature, when the engine has heated to a determined temperature.

In the above disclosure reference is made only to the use of a driving arrangement for the electrodes in the form of a solenoid. It is apparent, however, that the invention is not so limited, and any conventional operable driving means may be employed, such driving means being coupled to receive the current for providing the force to move the electrode as well as to apply the current to the electrode to support an arc. Such driving means may thus be mechanically operated by an air or hydraulic cylinder, but the invention is, of course, not limited to such further devices.

While the invention has been disclosed and described with reference to a limited number of embodiments, it is apparent that variations and modifications may be made therein, and it is therefore intended in the following claims to cover each such variation and modification as follows within the true spirit and scope of the invention.

What is claimed is:

1. In an ignition system for an internal combustion engine wherein a driving means is coupled mechanically to a movable electrode adapted to be positioned within a combustion chamber to effect the separation of the movable electrode and another electrode within the chamber that normally is adjacent the movable electrode, to produce an arc in the chamber, and an electric circuit is provided for applying current thereto from a source of current; the improvement wherein said current comprises an inductor, means for charging said inductor, and diode means poled to direct discharge current from said inductor, due to collapsing magnetic field, through said electrodes, whereby discharge current of said inductor feeds an arc formed upon separation of said electrodes.

2. In an ignition system for an internal combustion engine wherein a solenoid is coupled both mechanically and electrically to a movable contact adopted to be positioned within a combustion chamber to effect the separation of the movable electrode and another electrode within the chamber that normally contacts the movable electrode, to produce an arc in the chamber, and an electric circuit is provided for energizing said solenoid from a source of current; the improvement wherein said circuit comprises an inductor, means for charging said inductor, and diode means poled to direct discharge current from said inductor, due to collapsing magnetic field, to said solenoid for discharging said inductor through said solenoid, whereby discharge current of said inductor energizes said solenoid to separate said electrodes.

3. In an ignition system for an internal combustion engine wherein a solenoid is coupled mechanically to a movable electrode adopted to be positioned within a combustion chamber to effect the separation of the moveable electrode and another electrode within the chamber that normally is adjacent the movable electrode, to produce a spark in the chamber, and an electric circuit is provided for energizing said solenoid from a source of electric current; the improvement wherein said circuit comprises an inductor, means for charging said inductor, and diode means poled to inhibit current flow other than discharge current from inductor, with collapsing magnetic field, through electrodes, and to direct said discharge current from said inductor through said solenoid, whereby discharge current of said inductor energizes said solenoid to cause separation of said electrodes.

4. In an ignition system of claim 3 wherein the electrodes and solenoid are connected electrically in series configuration.

5. In an ignition system for an internal combustion engine wherein a solenoid is connected to effect the separation of normally contacting spark electrodes in a combustion chamber, and an electric circuit is provided for energizing said solenoid from a source of current; the improvement wherein said circuit comprises an inductor, first circuit means for directing current from said source to said inductor for charging said inductor, and second circuit means for directing current from said inductor by way of said second circuit means to said solenoid for discharging said inductor through said solenoid and spark electrodes, said second circuit means comprising means for inhibiting any other current flow to said solenoid other than discharge current of said inductor, whereby discharge current of said inductor energizes said solenoid to separate said spark electrodes causing arcing at said spark electrodes.

6. The ignition circuit of claim 5 where said second circuit means for directing current from the inductor to the solenoid includes a poled diode.

7. The ignition system of claim 5 wherein said first circuit means comprises periodically closing contact means.

8. The ignition system of claim 5 further comprising cam means synchronized with the rotation of said internal combustion engine for periodically closing said contact means.

9. The ignition system of claim 7 comprising means for spraying fuel into the combustion chamber adjacent the spark contacts.

10. The ignition system of claim 9 wherein the ignition system comprises a starting aid, and means disconnecting said ignition system when engine temperature is high enough so that combustion is accomplished solely by heat of compression.

* * * * *